US010196175B2

(12) United States Patent
Milburn

(10) Patent No.: US 10,196,175 B2
(45) Date of Patent: Feb. 5, 2019

(54) TOOL CHEST LIFTING SOLUTION

(71) Applicant: APEX BRANDS, INC., Apex, NC (US)

(72) Inventor: Cody Edward Milburn, Brookland, AR (US)

(73) Assignee: APEX BRANDS, INC., Apex, NC (US)

( * ) Notice: Subject to any disclaimer, the term of this patent is extended or adjusted under 35 U.S.C. 154(b) by 372 days.

(21) Appl. No.: 14/985,959

(22) Filed: Dec. 31, 2015

(65) Prior Publication Data

US 2017/0190472 A1 Jul. 6, 2017

(51) Int. Cl.
*B65D 25/28* (2006.01)
*B25H 3/02* (2006.01)

(52) U.S. Cl.
CPC ..... *B65D 25/2808* (2013.01); *B25H 3/02* (2013.01); *B65D 25/2841* (2013.01); *B65D 25/2897* (2013.01)

(58) Field of Classification Search
CPC .. B25H 3/02; B65D 25/2808; B65D 25/2897; B65D 25/2841
USPC ..... 206/372, 373; 220/761, 764, 765, 772
See application file for complete search history.

(56) References Cited

U.S. PATENT DOCUMENTS 3,811,747 A * 5/1974 Levin ..... B65D 21/0209 206/509
4,288,134 A * 9/1981 Knaack ..... A47B 81/00 312/100
4,936,476 A * 6/1990 Dinsmoor ..... B65D 88/121 220/1.5
4,982,860 A * 1/1991 Dinsmoor ..... B65D 88/121 108/51.11
6,581,796 B1 * 6/2003 Pilkinton ..... B65F 1/06 220/495.04
7,419,037 B2 * 9/2008 Nordstrom ..... A63B 55/60 190/107
7,494,011 B2 * 2/2009 Henssler ..... A45C 13/26 206/503
8,342,580 B2 * 1/2013 Cowie ..... B65D 19/08 292/104
2002/0101045 A1 * 8/2002 Schmidt ..... B25H 3/02 280/47.34
2007/0240462 A1 * 10/2007 James ..... B25H 3/02 70/159
2014/0312757 A1 * 10/2014 Bridges ..... A47B 91/024 312/351.3

* cited by examiner

*Primary Examiner* — Steven A. Reynolds
(74) *Attorney, Agent, or Firm* — McNair Law Firm, P.A.

(57) ABSTRACT

A tool chest may include a base portion and two opposing sidewalls. The sidewalls may extend substantially perpendicularly upward from the base portion to define a tool repository between the sidewalls. Each of the sidewalls may include a lift-handle assembly that includes a first handle and a second handle. Each of the sidewalls may include at least one recessed portion configured to receive at least one of the first handle or the second handle. The first and second handles may be rotatable between a rest position and a transport position such that the at least one of the first handle or the second handle extends through a plane defined by one of the sidewalls when in the transport position and does not extend through the plane when in the rest position.

18 Claims, 10 Drawing Sheets

TOOL CHEST LIFTING SOLUTION

TECHNICAL FIELD

Example embodiments generally relate to containers for storing tools where such containers are capable of being lifted and, in particular, relate to a tool chest that is adapted to be lifted from above.

BACKGROUND

Tool chests are familiar sights from worksites to garages. The tool chest allows tools to be stored in an organized way, but also typically provides the ability to store the tools in a secure manner. Given the cost, mobility and utility of hand tools and power tools, the ability to securely store the tools can be very important. This is particularly true at worksites where tools may need to remain for a period of time.

Tools, either individually or collectively, may also need to be transportable in many cases. For a small business or a homeowner, placing the tool chest itself on wheels can be a solution for mobility of a group of tools over a relatively small distance. However, some tool chests may need to be transported to different worksites that are geographically distant, at elevated locations, or that may need to be loaded aboard ships or other large (and sometimes mobile) platforms.

For a large tool chest, providing mobility can be a difficult proposition. Lifting from below may not be practical, or may be dangerous. Meanwhile, the tool chest is typically not structured to facilitate lifting from above (such as with a crane). An easy solution may be to extend receptacles or hook eyes off the top of the tool chest. In particular, such receptacles may be bolted or welded onto the top of the tool chest to extend upward and above the top of the tool chest at respective ends or sides of the tool chest. These receptacles may allow chain or cable hooks to attach to the receptacles at the top of the chest (e.g., via a chain sling). However, such receptacles are exposed to bending or breaking, and may also make stacking or storing of multiple tool chests more difficult. Moreover, these receptacles may not meet standards or certifications relating to the ability to safely lift the tool chest in various different contexts.

BRIEF SUMMARY OF SOME EXAMPLES

Some example embodiments may enable the provision of a tool chest that prevents exposure of handles while the tool chest is not being lifted, but which are easily extendible from recessed portions on the side of the tool chest to allow lifting or other moving of the tool chest.

In an example embodiment, a tool chest is provided. The tool chest may include a base portion and two opposing sidewalls. The sidewalls may extend substantially perpendicularly upward from the base portion to define a tool repository between the sidewalls. Each of the sidewalls may include a lift-handle assembly that includes a first handle and a second handle. Each of the sidewalls may include at least one recessed portion configured to receive at least one of the first handle or the second handle. The first and second handles may be rotatable between a rest position and a transport position such that the at least one of the first handle or the second handle extends through a plane defined by one of the sidewalls when in the transport position and does not extend through the plane when in the rest position.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

DETAILED DESCRIPTION

Figure 1:
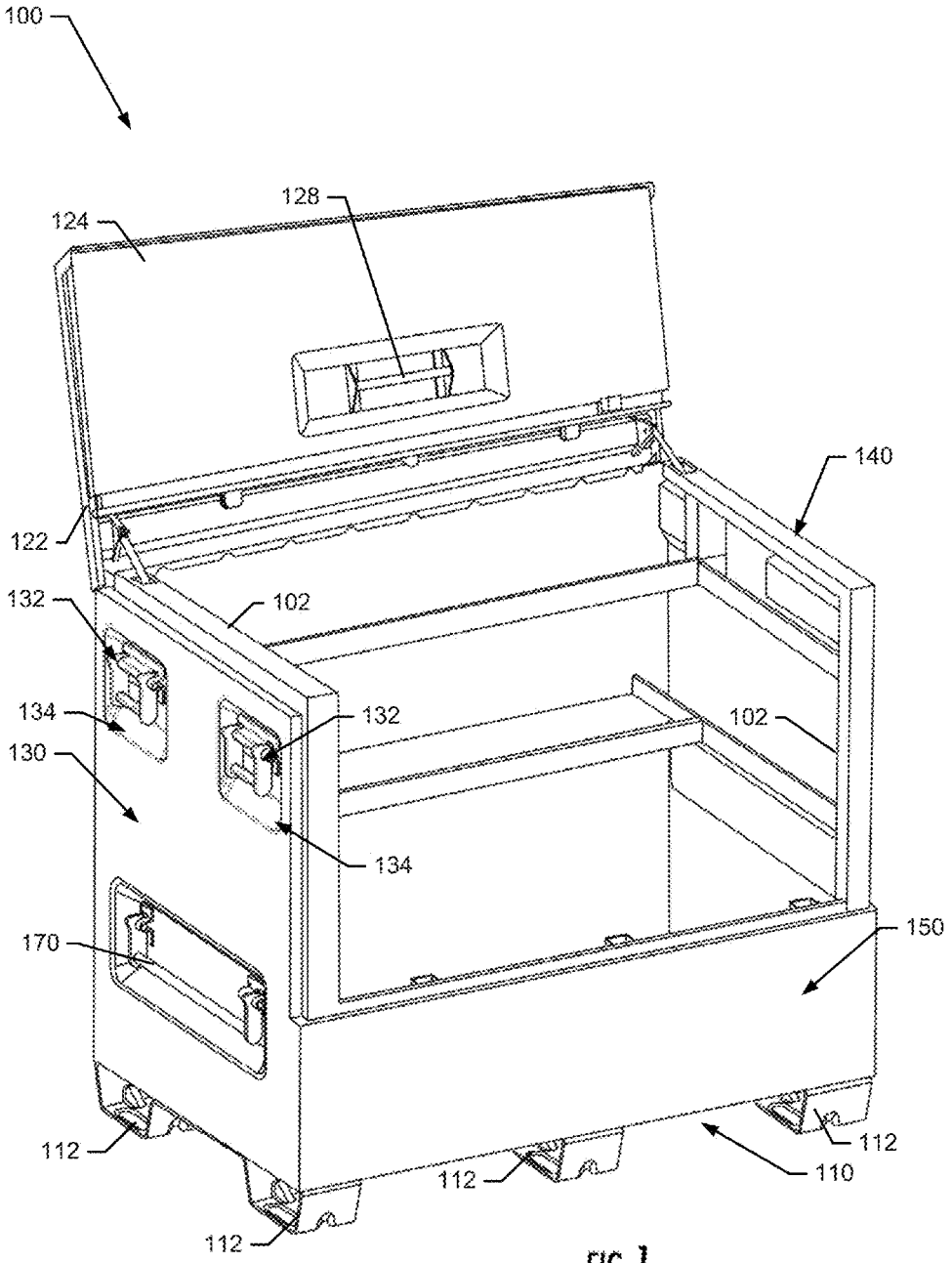
FIG. 1 illustrates a front perspective view of a tool chest with lid opened according to an example embodiment.
Figure 2:
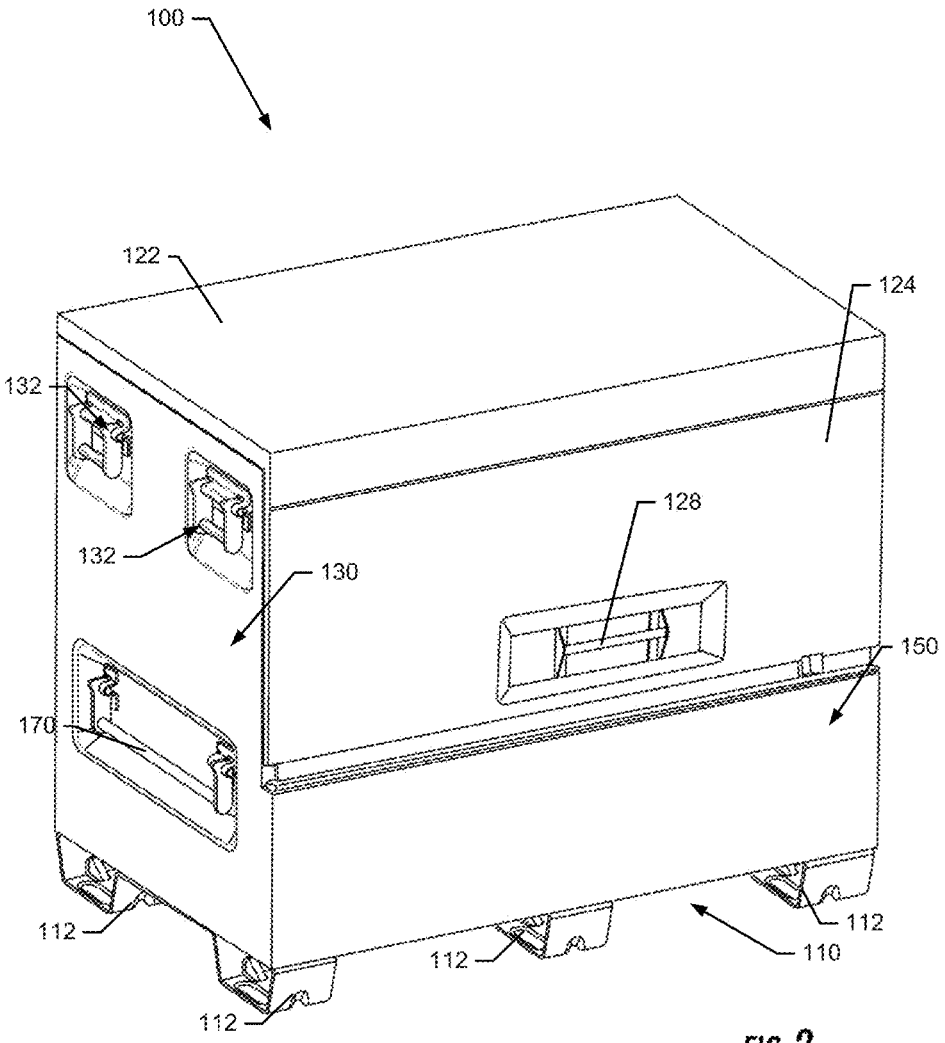
FIG. 2 illustrates a front perspective view of the tool chest with the lid closed according to an example embodiment.
Figure 3:
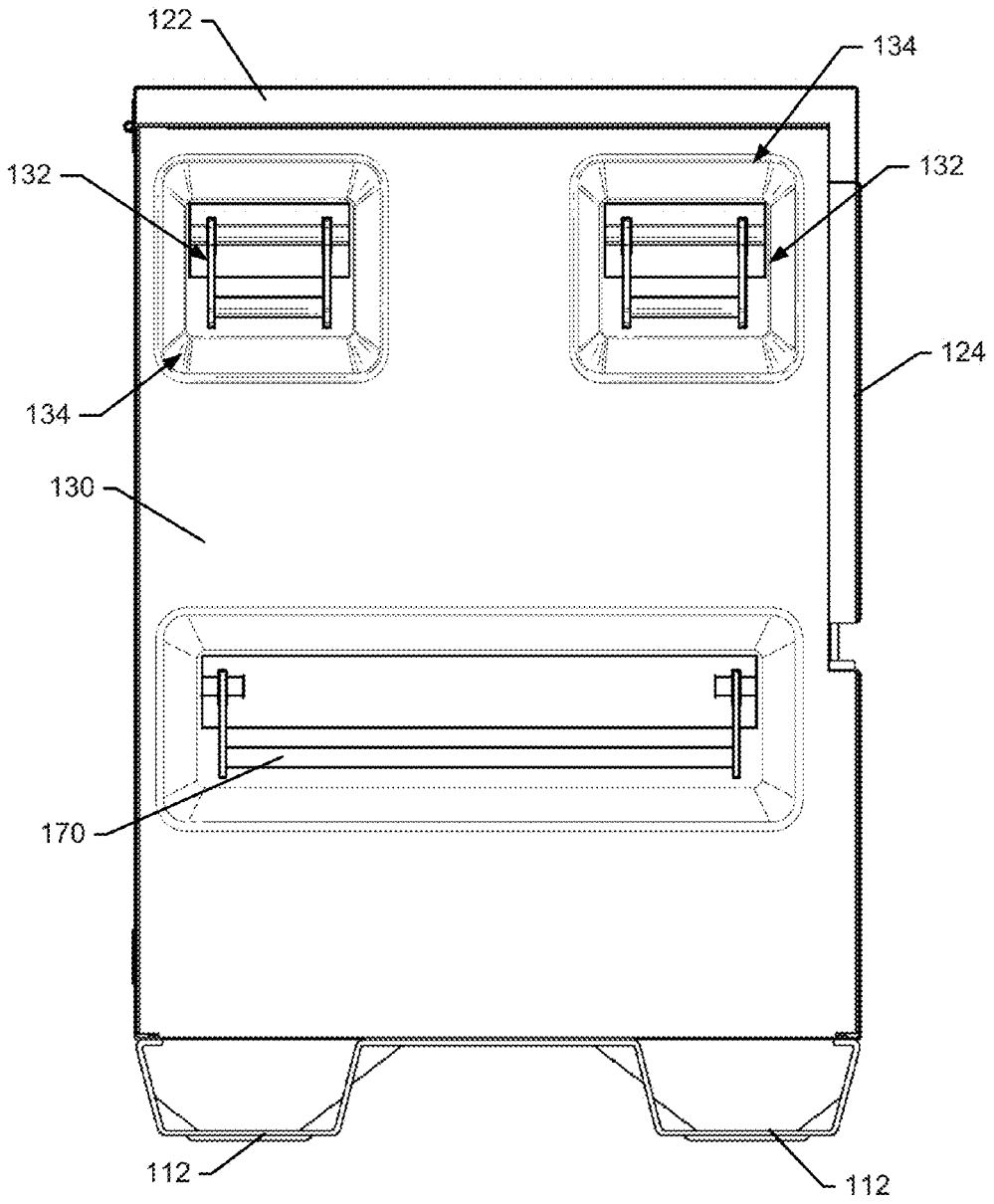
FIG. 3 is a side view of the tool chest according to an example embodiment.
Figure 4:
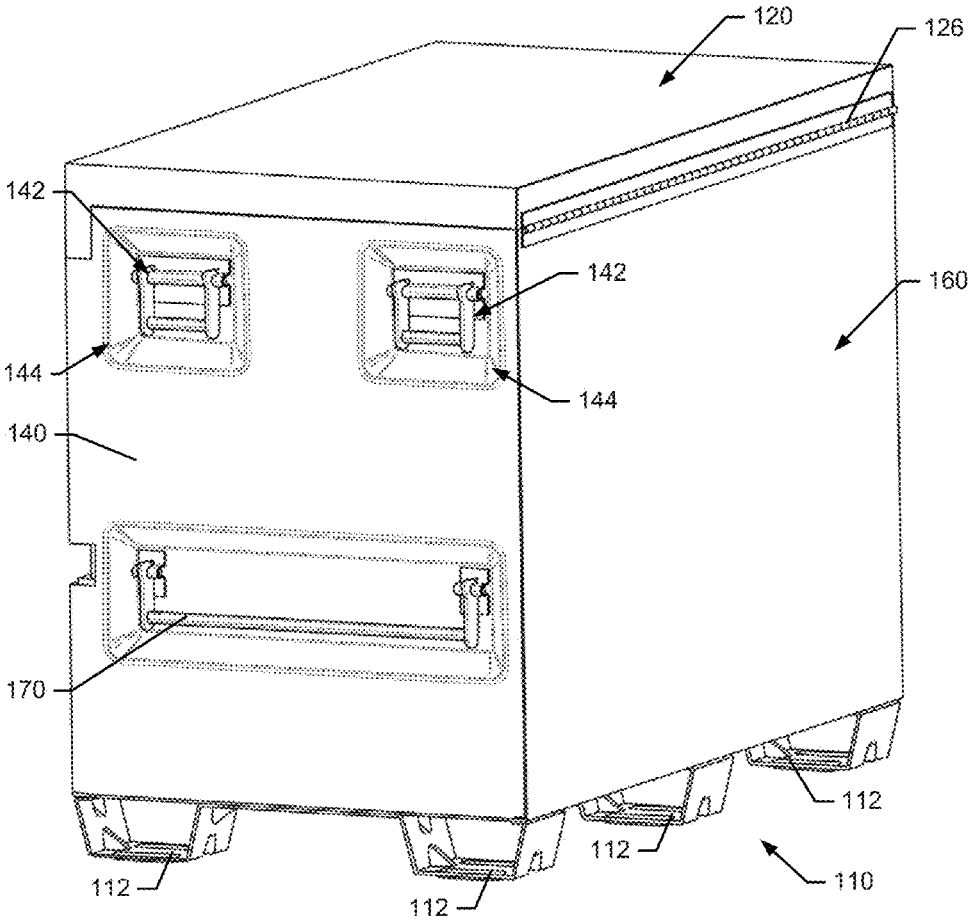
FIG. 4 illustrates a rear perspective view of the tool chest with the lid closed according to an example embodiment.
Figure 5:
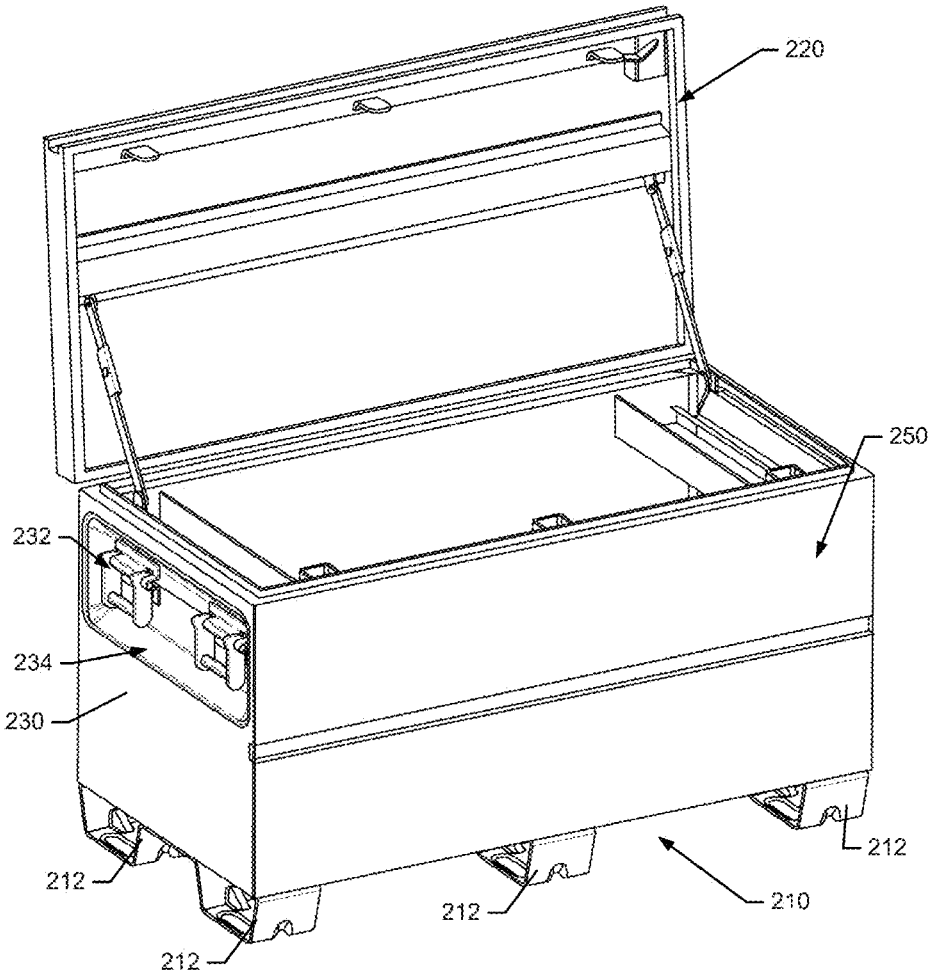
FIG. 5 illustrates a front perspective view of a tool chest with lid opened according to another example embodiment.
Figure 6:
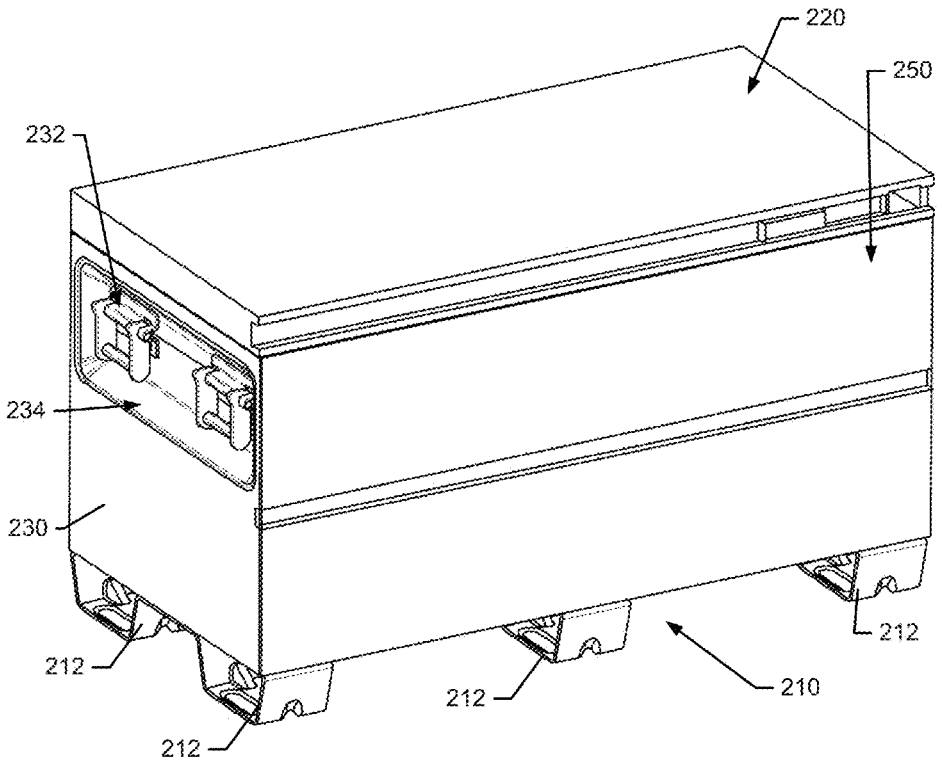
FIG. 6 illustrates a front perspective view of the tool chest of FIG. 5 with the lid closed according to an example embodiment.
Figure 7:
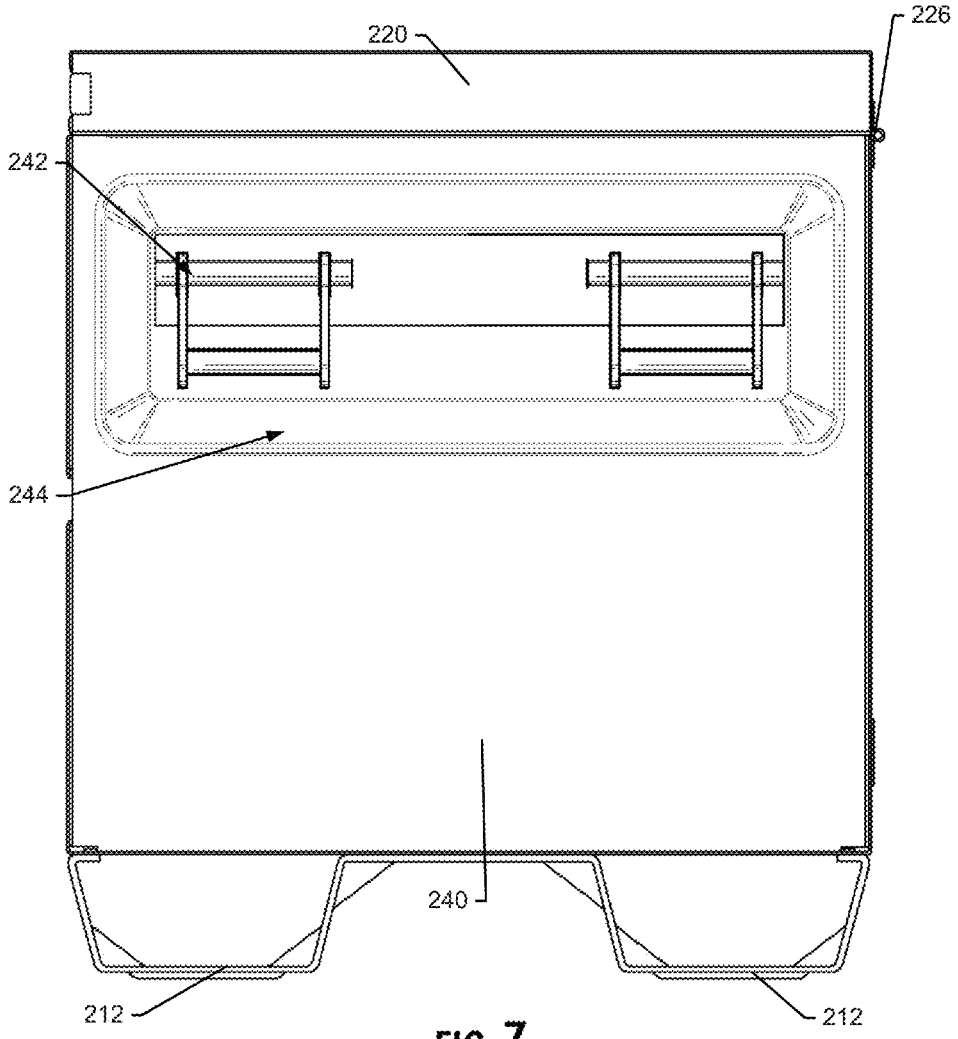
FIG. 7 is a side view of the tool chest of FIG. 5 according to an example embodiment.
Figure 8:
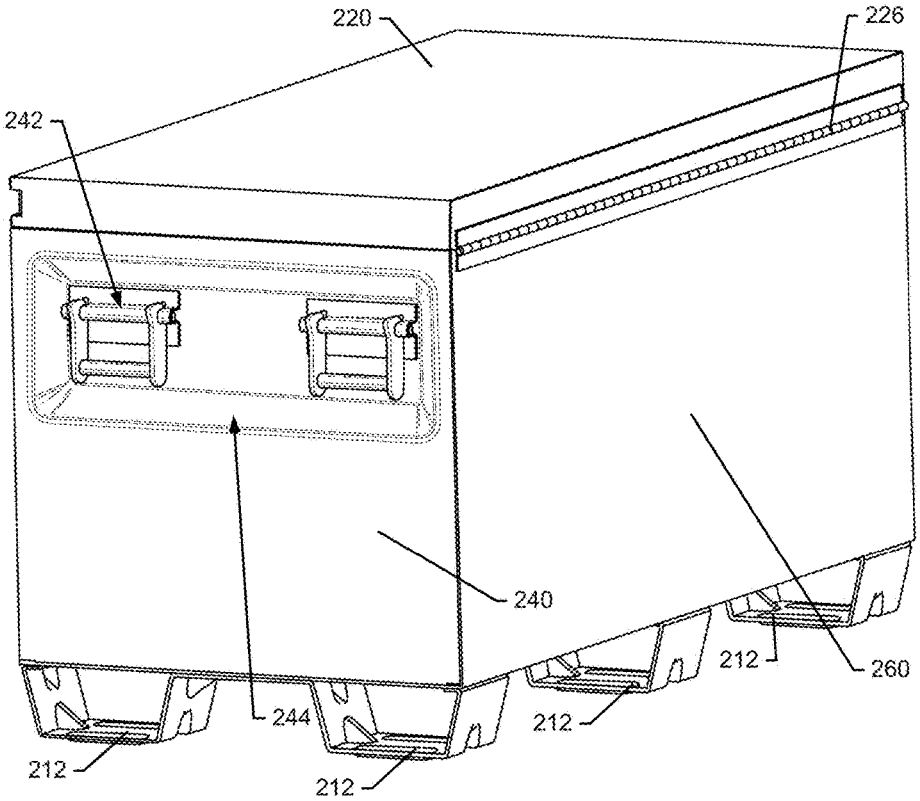
FIG. 8 illustrates a rear perspective view of the tool chest of FIG. 5 with the lid closed according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

As indicated above, some example embodiments may relate to the provision of a tool chest that prevents exposure of handles while the tool chest is not being lifted by having the handles recessed into sides of the tool chest. However, the recessed handles are rotatable from a rest position to a transport position in which the handles are extended from the sides of the tool chest to allow lifting or other moving of the tool chest. Two particular examples will be shown to illustrate two different designs for implementation of the recessed handles. However, it will be appreciated that example embodiments are not necessarily limited to the specific examples disclosed. FIGS. 1-4, 9 and 10 correspond to a first example embodiment having individually recessed handles, and FIGS. 5-8 and 11 correspond to a second example embodiment having handles recessed into a common recess.

Referring first to FIGS. 1-4, 9 and 10 a tool chest 100 according to the first example embodiment is provided having a base portion 110, a lid 120, a first sidewall 130, a second sidewall 140, a front wall 150 and a rear wall 160. In some cases, the front wall 150 and rear wall 160 may also be considered as sidewalls. In any case, the sidewalls may extend upward (e.g., at a substantially 90 degree angle) from the base portion 110 to define a tool repository or storage space between the sidewalls. The tool chest 100 may include frame members 102 that define the dimensions and provides structural support for the tool chest 100. The frame members 102 may also form the structure to which sheet metal forming the surfaces of the tool chest 100 are attached (e.g., via welding, bolting, riveting and/or the like). In some cases, various drawers, trays, shelves or other structures may also be supported by the frame members 102 or the sheet metal forming the surfaces of the tool chest 100 to allow tools to be supported within the tool chest 100.

Generally speaking, the tool chest 100 shown in FIGS. 1-4 has a longer length along a front and rear of the tool chest 100 than both the height and width of the tool chest 100. Moreover, the height of the tool chest 100 may be longer than the width of the tool chest 100. Thus, the tool chest 100 may form a substantially rigid rectangular box inside which tools can be stored via access provided by the lid 120. The frame members 102 may define the shape and provide rigidity and strength to the tool chest 100. In some embodiments, the frame members 102 may be steel or iron bars or tubes. In this regard, for example, the frame members 102 may have a rectangular cross section to facilitate operable coupling the sheet metal forming the surfaces of the tool chest 100. However, in other examples, frame members 102 (if employed) may be formed by bending some portions of the sheet metal at or near edges of the sheets that form the sides of the tool chest 100.

The base portion 110 may generally form the bottom of the tool chest 100. The base portion 110 of this example includes feet 112, which are made of sheet metal that is formed to enable the feet 112 to support the weight of the tool chest 100. The feet 112 may be provided at respective corners of the base portion 110 and at any other suitable locations in between to properly support the tool chest 100.

The lid 120 of this example includes a top portion 122 and a front portion 124 which can fold at the intersection therebetween. Meanwhile, the lid includes a hinge 126 that operably couples the lid 120 to the top of the rear wall 160. The lid 120 can be folded and opened to the position shown in FIG. 1, or unfolded and closed to the position shown in FIG. 2. When the lid is opened, the interior of the tool chest 100 is accessible through the top of the tool chest 100 and at least some portion of the front wall 150. The lid 120 may further include a lid handle 128 disposed in one or both of the front portion 124 and the top portion 122. The lid handle 128 may be used to lift and fold the lid 120.

As shown in FIGS. 1-4, the first sidewall 130 and the second sidewall 140 may substantially mirror each other in their respective structures. Moreover, a majority portion of each of the first sidewall 130 and the second sidewall 140 may lie in respective planes formed by sheet metal. The respective planes may be parallel to each other. However, each of the first sidewall 130 and the second sidewall 140 may include a respective lift-handle assembly (e.g., first lift-handle assembly 132 and second lift-handle assembly 142) that provides a pair of handles that are foldable toward and away from the first sidewall 130 and the second sidewall 140, respectively. The example of FIGS. 1-4 also shows that the tool chest 100 has a secondary handle 170 that may be foldable toward and away from the first sidewall 130 and the second sidewall 140, respectively.

The first and second lift-handle assemblies 132 and 142 are each provided in respective recessed portions (e.g., first recessed portion 134 and second recessed portion 144) formed in the first sidewall 130 and second sidewall 140, respectively. The first and second recessed portions 134 and 144 form recessed receptacles into which the handles of the first and second lift-handle assemblies 132 and 142 can entirely fold in the rest position. Thus, when in the rest position, no part of the first and second lift-handle assemblies 132 and 134 extends beyond the planes formed by the first sidewall 130 and the second sidewall 140, respectively. However, when the first and second lift-handle assemblies 132 and 144 are extended to the transport position (as shown in FIGS. 10 and 11), distal ends of the handles of the first and second lift-handle assemblies 132 and 142 extend out of the first and second recessed portions 134 and 144 and extend through the respective planes formed by the first and second sidewalls 130 and 142, respectively, away from the tool chest 100. The second lift-handle assembly 142 is substantially identical to the first lift-handle assembly 132 in form and function. Thus, only the first lift-handle assembly 132 will be described in greater detail in reference to FIGS. 9 and 10 below.

Referring now to FIGS. 5-8 and 11 a tool chest 200 according to the second example embodiment is provided having a base portion 210, a lid 220, a first sidewall 230, a second sidewall 240, a front wall 250 and a rear wall 260. The tool chest 200 may include frame members, similar to the description of the frame members of the first example embodiment described above. As described above, various drawers, trays, shelves or other structures may also be supported by the frame members or the sheet metal forming the surfaces of the tool chest 200 to allow tools to be supported within the tool chest 200.

The tool chest 200 shown in FIGS. 5-8 also has a longer length along a front and rear of the tool chest 200 than both the height and width of the tool chest 100. However, the height of the tool chest 200 may be approximately equal to or less than the width of the tool chest 200. Thus, the tool chest 200 of the second example embodiment may be shorter than the tool chest 100 of the first example embodiment. Because the tool chest 200 is shorter, there may be no need to have front access to the tool chest 200. As such, a lid 220 of the tool chest 200 may only cover an opening formed in the top of the tool chest 200.

The base portion 210 may generally form the bottom of the tool chest 200, and may include feet 212 similar to those described above. The lid 220 may include a hinge 226 that operably couples the lid 220 to the top of the rear wall 260. The lid 220 can be lifted and opened to the position shown in FIG. 5, or closed to the position shown in FIG. 6. When the lid 220 is opened, the interior of the tool chest 200 is accessible through the top of the tool chest 200.

As shown in FIGS. 5-8, the first sidewall 230 and the second sidewall 240 may substantially mirror each other in their respective structures. Moreover, a majority portion of each of the first sidewall 230 and the second sidewall 240 may lie in respective planes formed by sheet metal. The respective planes may be parallel to each other. However, each of the first sidewall 230 and the second sidewall 240 may include a respective lift-handle assembly (e.g., first lift-handle assembly 232 and second lift-handle assembly 242) that provides a pair of handles that are foldable toward and away from the first sidewall 230 and the second sidewall 240, respectively.

The first and second lift-handle assemblies 232 and 242 are each provided in respective recessed portions (e.g., first recessed portion 234 and second recessed portion 244) formed in the first sidewall 230 and second sidewall 240, respectively. The first and second recessed portions 234 and 244 form recessed receptacles into which the handles of the first and second lift-handle assemblies 232 and 242 can entirely fold in the rest position. Thus, when in the rest position, no part of the first and second lift-handle assemblies 232 and 242 extends beyond the planes formed by the first sidewall 230 and the second sidewall 240, respectively. However, when the first and second lift-handle assemblies 232 and 242 are extended to the transport position (as shown in FIGS. 10 and 11), distal ends of the handles of the first and second lift-handle assemblies 232 and 242 extend out of the first and second recessed portions 234 and 244 and extend through the respective planes formed by the first and second sidewalls 230 and 240, respectively, away from the tool chest 200. The first and second lift-handle assemblies 232 and 242 are substantially identical to the first lift-handle assembly 132 in form and function. Thus, only the first lift-handle assembly 132 will be described in greater detail in reference to FIGS. 9 and 10 below.

Figure 9:
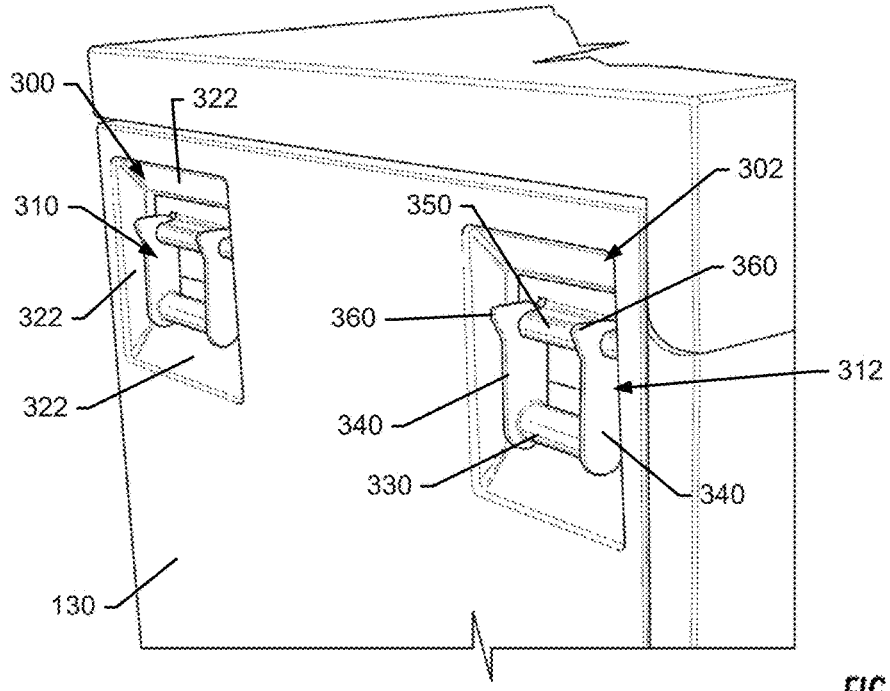
FIG. 9 is a perspective view of the handle assembly of the tool chest of FIG. 1 in a rest position according to an example embodiment.
Figure 10:
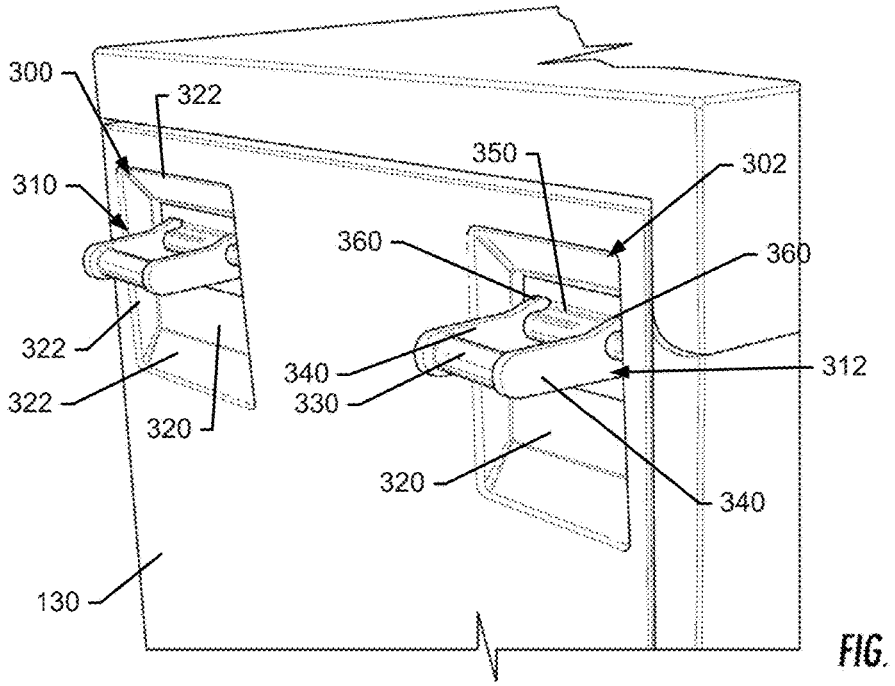
FIG. 10 is a perspective view of the handle assembly of the tool chest of FIG. 1 in a transport position according to an example embodiment.
Figure 11:
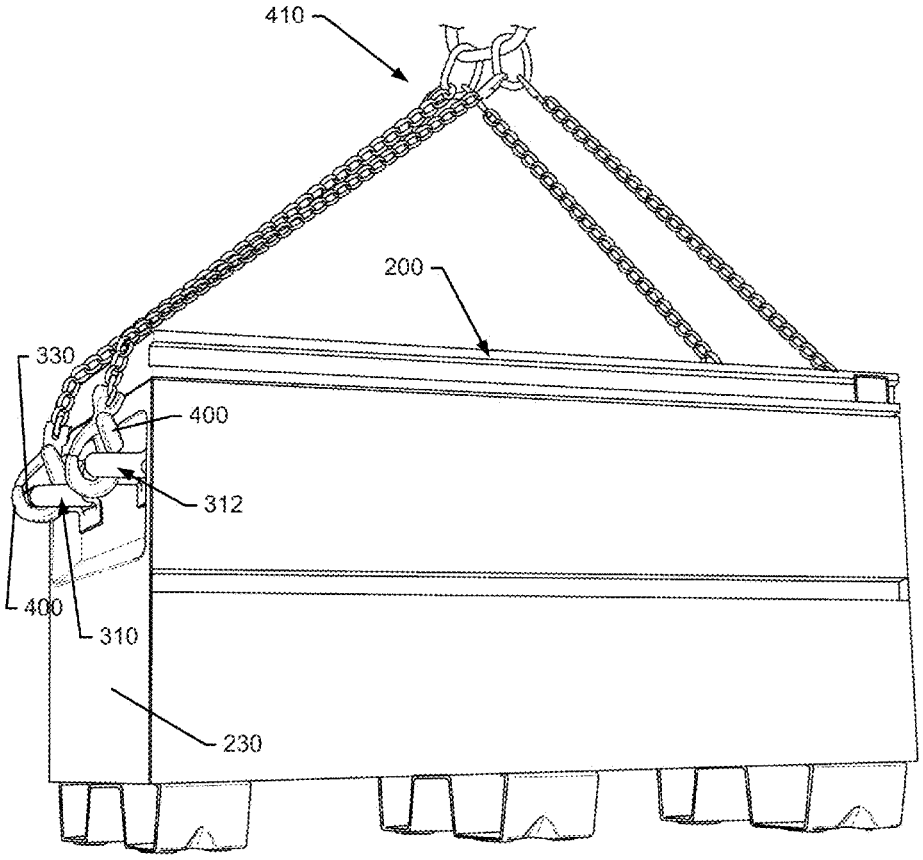
FIG. 11 is a perspective view of the tool chest of FIG. 5 in a transport position and operably coupled to a chain sling according to an example embodiment.

FIG. 9 illustrates a perspective view of the first handle assembly 132 in a rest position and FIG. 10 illustrates a perspective view of the first handle assembly 132 in the transport position in accordance with an example embodiment. Of note, in the example of FIGS. 9 and 10, the first recessed portion 134 is defined by a first pocket 300 and a second pocket 302. A first handle 310 of the first lift-handle assembly 132 is provided in the first pocket 300 and a second handle 312 of the first lift-handle assembly 132 is provided in the second pocket 302. This differs from the second example embodiment of FIGS. 5-8 in that the second example embodiment provides a single pocket in which both the first and second handles 310 and 312 (of the first handle assembly 232) would be located.

As shown in FIGS. 9 and 10, the first and second pockets 300 and 302 may have identical structures. In this regard, the first and second pockets 300 and 302 may be defined by a back wall 320 that lies in a plane substantially parallel to the plane in which the first sidewall 130 lies. However, the back wall 320 may be inset (i.e., spaced apart from the first sidewall 130 in a direction toward the interior of the tool chest 100) by at least a length that is deep enough to ensure that no part of the first and second handles 310 and 312 pass through the plane of the first sidewall 130 when the first and second handles 310 and 312 are in the rest position (of FIG. 9), but shallow enough to allow the first and second handles 310 and 312 to pass through the plane of the first sidewall 130 when the first and second handles 310 and 312 are rotated to the transport position (of FIG. 10). Thus, for example, the depth of the first and second pockets 300 and 302 may be greater than a width of the first and second handles 310 and 312. The back wall 320 engages sidewalls 322 of the first and second pockets 300 and 302 at respective edges of the back wall 320.

The sidewalls 322 of some example embodiments may form an obtuse angle relative to the portion of the back wall 320 that supports the first and second handles 310 and 312. The sidewalls 322 form an acute angle relative to the portion of the plane in which the first sidewall 130 lies where such plane covers the first and second handles 310 and 312. Thus, the sidewalls 322 of each of the first and second pockets 300 and 302 are formed as four separate slanted walls that extend between the first sidewall 130 and the back wall 320. In some embodiments, the slopes of all of the sidewalls 322 may be equal, and each sidewall 322 may engage its adjacent sidewalls to form an angled corner and define the first and second pockets 300 and 302. The single pocket of the second example embodiment is formed in a similar fashion. However, it should be appreciated that the sidewalls 322 could be formed at substantially right angles to the back wall 320 (and the first or second sidewall 130/140).

In an example embodiment, the first and second pockets 300 and 302 are positioned as far upward as possible. Thus, for example, the first and second pockets 300 and 302 are positioned as high up on the first sidewall 130 as the location of the frame members 102 will allow. The first and second pockets 300 and 302 may also be positioned as far rearward and forward as possible, respectively. In an example embodiment, the first and second pockets 300 and 302 may therefore be immediately adjacent to the top frame member and the rear or front frame member. This positioning may provide additional strength and support for the lifting points defined within the first and second pockets 300 and 302. In the second example embodiment (i.e., where only the single pocket is employed), the single pocket may extend entirely between the highest and forward/rearward-most possible locations on the sidewalls so that a single back wall lies proximate to both the first and second handles 310 and 312.

In the first example embodiment, the first and second handles 310 and 312 may be substantially centered on the back wall 320. However, in the second example embodiment, the first and second handles 310 and 312 may be disposed to be centered between top and bottom sidewalls of the single pocket, but may be positioned proximate to respective rear and front edges of the single back wall. In some embodiments, a horizontal plane and a vertical plane may be passed through the longitudinal centerline of the tool chest (100 or 200). The first and second handles 310 and 312 may be spaced apart from both the vertical plane and the horizontal plane by distances greater than the distance separating the first and second handles 310 and 312 from the front and rear edges and from the top edges of the tool chest (100 or 200), respectively. Moreover, in some cases, the first and second handles 310 and 312 may be disposed in a range of vertical positions at between 5% and 25% of the height of the tool chest (100 or 200) from the top of the tool chest (100 or 200). Similarly, the first and second handles 310 and 312 may be placed at horizontal positions that are between 5% and 40% of the width of the tool chest (100 or 200) from the respective front and rear edges of the tool chest (100 or 200). This arrangement may maximize the distance of the handles above and forward/rearward of the center of gravity of the tool chest (100 or 200) and provide improved stability during lifting operations.

Each of the first and second handles 310 and 312 may include an engagement portion 330 (or cross bar) that extends between distal ends of pivot plates 340 that extend parallel to each other. The pivot plates 340 may each lie in planes that are perpendicular to the plane of the first sidewall 130 are pivotally coupled to an axis 350 to rotate about the axis 350. The axis 350 may be formed of a bar or axle that is rotatable in a sheath that may, for example, be welded to the back wall 320. However, other structures are also possible.

The pivot plates 340 may be substantially flat, plate-like structures that are rotatably coupled to the axis 350 at their proximal ends and operably coupled to the engagement portion 330 at their distal ends. Thus, the distance between the pivot plates 340 may be defined by the length of the engagement portion 330. The pivot plates 340 may rotate about the axis 350 between the rest position of FIG. 9 and the transport position of FIG. 10. As shown in FIGS. 9 and 10, the rest position and transport position may differ by about 90 degrees. In an example embodiment, the weight of the engagement portion 330 may be sufficient to bias the first and second handles 310 and 312 (i.e., by gravity) to the rest position. Thus, the first and second handles 310 and 312 may only be rotatable to the transport position manually, such as by hand or by engagement with a hook or other implement for lifting.

In order to limit the movement of the pivot plates 340 to provide the desired angular difference between orientation of the first and second handles 310 and 312 in the rest position and the transport position, the pivot plates 340 may each be provided with a stopping member 360 at their respective proximal ends. The stopping member 360 may protrude away from the back wall 320 when the first and second handles 310 and 312 are in the rest position. However, when the first and second handles 310 and 312 are rotated to the transport position (i.e., 90 degrees away from the rest position, the stopping member 360 may impact the back wall 320 to stop further rotation of the pivot plates 340. The stopping member 360 may also provide reinforcement of the pivot plate 340 to allow the weight of the tool chest 100 to be borne by the first and second handles 310 and 312 in the transport position (as shown in FIG. 11). The stopping member 360 may define the maximum width of the pivot plates 340 and therefore also the first and second handles 310 and 312.

FIG. 11 illustrates the second example embodiment (i.e., the tool chest 200) with the first and second handles 310 and 312 rotated to the transport position. As shown in FIG. 11, when the first and second handles 310 and 312 are extended to the transport position, a hook 400 of a chain sling 410 can easily engage the engagement portion 330 of each of the first and second handles 310 and 312. The hook 400 can then be suspended (via the chain sling 410) to lift the tool chest 200. Moreover, the ability to access the engagement portion 330 outside the plane of the first sidewall 230 allows the chain of the chain sling 410 to avoid being contorted or bent excessively, and also allows a good lifting angle to be employed by the chain sling 410 to improve the safety and security of the lifting operation. In some cases, an angle of about 60 degrees or more between the chain and the top of the tool chest 200 may be desirable, and may be achievable by extending the first and second handles 310 and 312 to the transport position.

In an example embodiment, a tool chest is provided. The tool chest may include a base portion and two opposing sidewalls. The sidewalls may extend substantially perpendicularly upward from the base portion to define a tool repository between the sidewalls. Each of the sidewalls may include a lift-handle assembly that includes a first handle and a second handle. Each of the sidewalls may include at least one recessed portion configured to receive at least one of the first handle or the second handle. The first and second handles may be rotatable between a rest position and a transport position such that the at least one of the first handle or the second handle extends through a plane defined by one of the sidewalls when in the transport position and does not extend through the plane when in the rest position.

The tool chest may be modified or augmented with additional (optional) features. For example, in some cases, the at least one recessed portion may include a first pocket corresponding to the first handle and a second pocket, spaced apart from the first pocket, the second pocket corresponding to the second handle. Additionally, in some cases, the first and second pockets may each be defined at least in part by a back wall that lies in second plane parallel to the plane defined by the one of the sidewalls, where the first and second handles are each centered on the back wall of respective ones of the first pocket and the second pocket. Additionally or alternatively, the first and second pockets may be further defined by pocket sidewalls that each form an angle relative to the back wall and the sidewalls of the tool chest. Additionally or alternatively, a depth of each of the first and second pockets is greater than a width of the first and second handles. Instead of multiple pockets, some example embodiments may be designed such that the at least one recessed portion includes a single pocket inside which both the first handle the second handle are provided. In such an example, the single pocket may be defined at least in part by a back wall that lies in second plane parallel to the plane defined by the one of the sidewalls, where the first and second handles are each rotatably coupled to the back wall. Additionally or alternatively, the single pocket may be further defined by pocket sidewalls that each form an angle relative to the back wall and the one of the sidewalls of the tool chest. Additionally or alternatively, a depth of the single pocket is greater than a width of the first and second handles. Additionally or alternatively, the tool chest may be defined at least in part by frame members disposed inside the sidewalls to support the sidewalls. In such an example, the at least one recessed portion may be defined proximate to a top of the tool chest and proximate to front and rear edges of the sidewalls. Additionally or alternatively, the at least one recessed portion may be spaced apart from the top of the tool chest and the front and rear edges of the sidewalls by a width of corresponding ones of the frame members. Additionally or alternatively, the first and second handles may be disposed proximate to a top of the tool chest and proximate to front and rear edges of the sidewalls. Additionally or alternatively, the first and second handles may each include an engagement portion, pivot plates disposed on opposite ends of the engagement portion, the engagement portion being provided at a distal end of the pivot plates, and an axis about which the pivot plates rotate, where the pivot plates are pivotally coupled to the axis at a proximal end of the pivot plates. In such an example, the engagement portion may be located within the at least one recessed portion in the rest position, and extends outside the at least one recessed portion in the transport position. Additionally or alternatively, the pivot plates may each include a stopping member disposed at the proximal end of the pivot plates. Additionally or alternatively, the at least one recessed portion may be defined at least in part by a back wall that lies in second plane parallel to the plane defined by the one of the sidewalls, and the stopping member may be disposed at a side of each of the pivot plates that faces away from the back wall. Additionally or alternatively, the stopping member may include a protrusion that does not contact the back wall in the rest position and contacts the back wall in the transport position. Additionally or alternatively, the stopping member may prevent movement of the first and second handles beyond about ninety degrees from the rest position when the first and second handles are moved to the transport position. Accordingly, for example, the first and second handles are extendable in the transport position to engage a lifting apparatus (e.g., a chain sling or hooks thereof) at lifting points farther apart from each other than a longitudinal length of the tool chest.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A tool chest comprising:

a base portion; and two opposing sidewalls extending substantially perpendicularly upward from the base portion to define a tool repository between the sidewalls, wherein each of the sidewalls comprises a lift-handle assembly, each lift-handle assembly comprising a first handle and a second handle, wherein each of the sidewalls includes at least one recessed portion configured to receive at least one of the first handle or the second handle, wherein the first and second handles are rotatable between a rest position and a transport position such that the at least one of the first handle or the second handle extends through a plane defined by one of the sidewalls when in the transport position and does not extend through the plane when in the rest position, wherein the first and second handles each comprise:

an engagement portion;

pivot plates disposed on opposite ends of the engagement portion, the engagement portion being provided at a distal end of the pivot plates, each of the pivot plates including a stopping member disposed at a proximal end of the pivot plates, the stopping member protruding away from a back wall of the at least one recessed portion when the first and second handles are in the rest position and engaging the back wall when the first and second handles are in the transport position; and an axis about which the pivot plates rotate, the pivot plates being pivotally coupled to the axis at the proximal end of the pivot plates.

2. The tool chest of claim 1, wherein the at least one recessed portion comprises a first pocket corresponding to the first handle and a second pocket, spaced apart from the first pocket, the second pocket corresponding to the second handle.

3. The tool chest of claim 2, wherein the first and second pockets are each defined at least in part by the back wall that lies in second plane parallel to the plane defined by the one of the sidewalls, the first and second handles each being centered on the back wall of respective ones of the first pocket and the second pocket.

4. The tool chest of claim 3, wherein the first and second pockets are further defined by pocket sidewalls that each form an angle relative to the back wall and the sidewalls of the tool chest.

5. The tool chest of claim 2, wherein a depth of each of the first and second pockets is greater than a width of the first and second handles.

6. The tool chest of claim 1, wherein the at least one recessed portion comprises a single pocket inside which both the first handle the second handle are provided.

7. The tool chest of claim 6, wherein the single pocket is defined at least in part by the back wall that lies in second plane parallel to the plane defined by the one of the sidewalls, the first and second handles each being rotatably coupled to the back wall.

8. The tool chest of claim 7, wherein the single pocket is further defined by pocket sidewalls that each form an angle relative to the back wall and the one of the sidewalls of the tool chest.

9. The tool chest of claim 6, wherein a depth of the single pocket is greater than a width of the first and second handles.

10. The tool chest of claim 1, wherein the tool chest is defined at least in part by frame members disposed inside the sidewalls to support the sidewalls.

11. The tool chest of claim 10, wherein the at least one recessed portion is defined proximate to a top of the tool chest and proximate to front and rear edges of the sidewalls.

12. The tool chest of claim 11, wherein the at least one recessed portion is spaced apart from the top of the tool chest and the front and rear edges of the sidewalls by a width of corresponding ones of the frame members.

13. The tool chest of claim 1, wherein the first and second handles are disposed proximate to a top of the tool chest and proximate to front and rear edges of the sidewalls.

14. The tool chest of claim 13, wherein the first and second handles are spaced apart from both a vertical plane and a horizontal plane passing through a longitudinal centerline of the tool chest by distances greater than a distance separating the first and second handles from the front and rear edges and from the top edges of the tool chest, respectively.

15. The tool chest of claim 13, wherein the first and second handles are disposed vertically at a position on the sidewalls at between 5% and 25% of a height of the tool chest relative to a top of the tool chest, and wherein the first and second handles are disposed horizontally at a position on the sidewalls at between 5% and 40% of a width of the tool chest from respective front and rear edges of the tool chest.

16. The tool chest of claim 1, wherein the engagement portion is located within the at least one recessed portion in the rest position, and extends outside the at least one recessed portion in the transport position.

17. The tool chest of claim 1, wherein the stopping member prevents movement of the first and second handles beyond about ninety degrees from the rest position when the first and second handles are moved to the transport position.

18. The tool chest of claim 1, wherein the first and second handles are extendable in the transport position to engage a lifting apparatus at lifting points farther apart from each other than a longitudinal length of the tool chest.

* * * * *